United States Patent [19]

Zurcher

[11] 4,111,518

[45] Sep. 5, 1978

[54] QUICK CONNECT AND NON-DESTRUCTIVE DISCONNECT ELECTRICAL WIRING-CONNECTOR DEVICE

[75] Inventor: Rudolf F. Zurcher, Newport Beach, Calif.

[73] Assignee: Hughes Aircraft Company, Culver City, Calif.

[21] Appl. No.: 781,083

[22] Filed: Mar. 25, 1977

Related U.S. Application Data

[63] Continuation of Ser. No. 608,434, Aug. 28, 1975, abandoned.

[51] Int. Cl.[2] ..... H01R 13/06

[52] U.S. Cl. ..... 339/252 R; 339/276 SF

[58] Field of Search ..... 339/17, 19, 95 B, 222, 339/224, 252, 276 SF; 58/23 R, 23 BA, 50 R

[56] References Cited

U.S. PATENT DOCUMENTS

| | | | |
|---|---|---|---|
| 1,021,377 | 3/1912 | Royce | 339/252 R |
| 2,740,097 | 3/1956 | Edelman et al. | 339/252 P |
| 2,817,827 | 12/1957 | Burkhardt | 339/252 R |
| 2,945,205 | 7/1970 | Dierstein | 339/252 R |
| 3,182,276 | 5/1965 | Ruehlemann | 339/276 SF |
| 3,378,665 | 4/1968 | Pater et al. | 339/252 R |
| 3,953,096 | 4/1976 | Williams | 339/276 SF |

FOREIGN PATENT DOCUMENTS

| | | | |
|---|---|---|---|
| 6,402,914 | 9/1965 | Netherlands | 339/17 R |
| 110,796 | 11/1917 | United Kingdom | 339/252 R |

*Primary Examiner*—Joseph H. McGlynn
*Attorney, Agent, or Firm*—Lewis B. Sternfels; W. H. MacAllister

[57] ABSTRACT

An electronic device, e.g., a quartz crystal in an enclosure having three stubby leads for use in an electronic watch, is mounted adjacent to a substrate having three feedthrough holes near its perimeter. Connection between the substrate and the three stubby leads are made simultaneously by three individual connection devices all attached to a tab through individual breakaway neck portions. Each connection device comprises a tail which is forked for insertion by interference fit into the feedthrough holes in the substrate. At the opposite end from the tail is a keyhole opening, in which the larger hole fits over one of the stubby leads and in which a smaller hole can be slid onto the lead by a force fit. Thus, in operation, the bifurcated tails of each device are placed through the feedthrough holes and the keyhole openings of each device are placed over their respective stubby leads. By pulling on the tab common to the three connector devices, the smaller hole of each keyhole opening is force fitted onto the stubby lead, after which the tab is broken away from the respective connector devices at the necked-down portions. A tooling hole in each connector device adjacent the keyhole opening permits removal of individual connector devices, such as by a hooked tool.

1 Claim, 5 Drawing Figures

QUICK CONNECT AND NON-DESTRUCTIVE DISCONNECT ELECTRICAL WIRING-CONNECTOR DEVICE

This is a continuation application of Ser. No. 608,434 filed Aug. 28, 1975, now abandoned.

BACKGROUND OF THE INVENTION

1. Field of the Invention

The present invention relates to a solderless electrical connector device.

2. Description of the Prior Art

In many electronic devices, especially of very small size, e.g., electronic watches, there is little or no room for connecting leads between two connection points. In many cases, for example, connection must be made to a plated-through hole in which the lead must be bent and inserted directly into the hole. While separate connecting wires could be strung from the holes to the leads and soldered into position, the lack of available space may make such an operation extremely expensive, if not impractical, and may damage adjacent structure or components. For example, the electronic device may not be able to withstand the heat of a soldering operation, aside from whatever care and time must be taken therefor. Conductive epoxies have been used for connective and electrical bonds but manytimes are structurally unsound, in part, because of the lack of available space and because of the minute amounts of conductive epoxy which must be utilized. As a further disadvantage of conventional soldering and conductive epoxy bonding, should it become necessary to remove the connection, such as for repair or replacement of parts or components, it is necessary to separate or otherwise remove the soldered or epoxied wire from their respective connections. Such removal may result in destruction or compromise to components. In any event, removal is made considerably more difficult by the very fact that a mechanical bond by soldering or conductive epoxy has been made and must be removed.

SUMMARY OF THE INVENTION

The present invention overcomes these and other problems by providing for one or more electrically conductive elements, each having a latching means, such as a hole of at least two dimensions. The first dimension is larger than the wire while the second dimension is smaller than the wire so that the electrically conductive element can be placed over the wire and then pulled into an interference connection with the wire. Any other means that provides for an interference fit is acceptable, such as a "Speed Nut". At the other end of the conductive element is a means for permitting the conductive element to connect the wire to some other component. For example, if connection is made through a hole having a conductive lining therein, the conductive element may terminate in a forked tail which can be inserted by force fit into the lined hole.

If two or more conductive elements are used together, they may be all joined to a common tab through individual breakaway, necked-down portions, so that the tails may be inserted into the respective holes and the larger dimensioned holes of the elements may be placed over the leads. Upon pulling on the tab, first the smaller holes in the elements are forced onto the wires and, thereafter, the tab breaks away from each of the conductive elements at the necked-down portions.

If desired, a small hole in each conductive element may be used for removal of the conductive element should replacement be required. For this purpose, the hooked instrument, such as a crochet hook, may be inserted into the small holes so as to remove the conductive elements.

It is, therefore, an object of the present invention to provide for an electrical connector device which requires no permanent connection, such as by solder or conductive epoxy, to effect its electrical connection.

Another object of the present invention is to provide for manipulation of extremely small connector devices.

Another object is to provide for a multiple connection of such connector devices.

Another object is to provide for a simple, substantially single operation of connecting a multiplicity of connections at the same time.

Another object is to provide for easy replacement and reuse of a connector device in the factory and in the field.

Another object is to provide for minimum complexity in making connections.

Another object is to provide for an easily manufactured electrical connector device, especially by mass production techniques.

Another object is to provide for miniature electrical connections in electronic watches.

Other aims and objects as well as a complete understanding of the present invention will appear from the following explanation of an exemplary embodiment and the accompanying drawings thereof.

DESCRIPTION OF THE PREFERRED EMBODIMENTS

While the present invention has particular use for joining leads extending from a can containing a quartz crystal resonator in an electronic watch, it is to be understood that the principles thereof are more broadly applicable to joining of any electronic components. Nevertheless, because of its preferred use and application, the following description will be specifically directed to the preferred embodiment and use.

Figure 1:
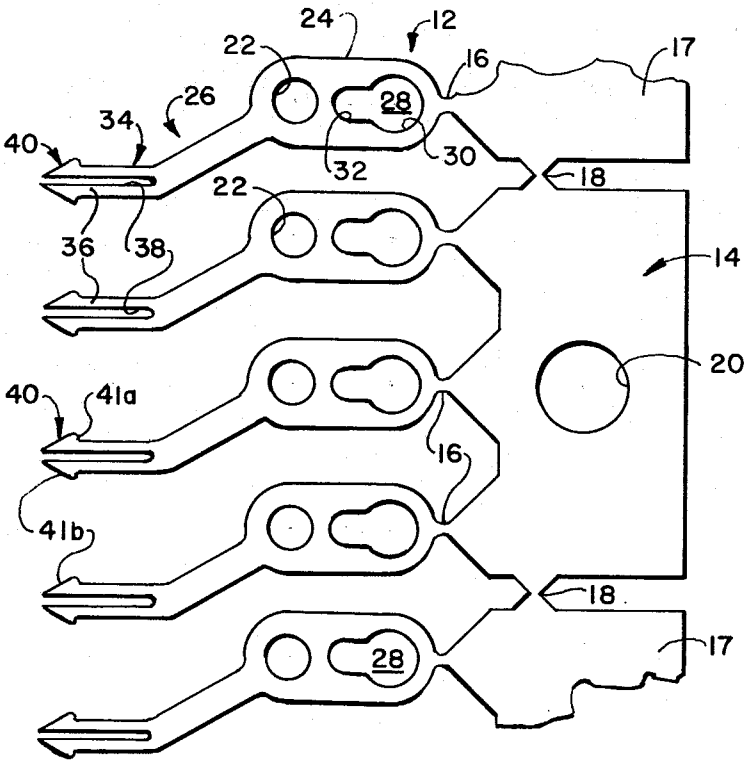
FIG. 1 illustrates the present invention comprising groups of three electronically conductive elements joined to a common tab.

Accordingly, with reference to FIG. 1, an electrical connector device 10 comprises a plurality of electrically conductive elements 12 individually joined to a common tab 14 by a necked-down portion 16. As shown, electrically conductive elements 12 are arranged in groups of three per tab 14. Tab 14 is joined with adjacent tabs 17 by breakaway portions 18. This particular arrangement permits the invention to be manufactured by simple stamping from sheet or ribbon stock, for example, of stainless steel. By well known stamping or chemical milling/etching operations, the several tabs 14 and 17 and electrically conductive elements 12 may be formed as shown and described hereinafter. For this purpose, a pull-on tooling hole 20 in each tab may be utilized for progressive movement during the manufacturing stamping operation. Similar tooling holes 22 are formed in each electrically conductive element 12 for purposes to be discussed hereinafter but also may be used for manufacturing purposes.

Each electrically conductive element 12 includes a body 24 and a depending tail 26. Tail 26 may be offset from body 24, as in FIG. 1, or symmetrical, as in FIGS. 2–5. In body 24 is an opening 28 having a general configuration of a key hole opening including a large dimensioned hole 30 and a smaller dimensioned slotted hole 32, the sizes thereof to be described with reference to its operation. The tail terminates in a bifurcated end 34 comprising a pair of tines 36 with a slot 38 therebetween. Although shown as two tines, one or three or more tines may be used. Also, several tails 26 may be joined to or be used in place of body 24. Thus, a single element 12 may be used to form a junction with several connection points with the inventive tear-away feature placed midway, for example, between a pair of double headed tails, each having the appearance of tail 26. Each tine is provided at its tip with an enlarged head 40 with latching surfaces **41*a* and sloped sides 41*b***.

In its preferred use as a connector for use in an electronic watch, of necessity, elements 12 must be of very small size. For purposes of illustration, each element has a length from the end 34 of tail 26 to breakaway portion 16 of approximately 0.270 inch (6.86 mm). The width of body 24 is 0.060 inch (1.52 mm). A width of tail 26 at its narrowest portion is 0.028 inch (0.71 mm). The thickness of elements 12 and tabs 14 is 0.002 inch (0.05 mm). The elements may be made of stainless steel having a thickness of 0.002 inch (0.05 mm) and a minimum yield strength of 140,000 psi (98 kp/mm$^2$). Thus, the shear strength at necked-down portion 16 is designed to have a pull strength of about 2 pounds (0.91 kp).

In manufacturing the invention, it is desired to provide groups of elements 12 attached to tabs 14 and 17. In use, each tab 14 may be separated from its adjoining tab 17 as will be described shortly and individual elements 12 may be grouped in groups of or two or more than three elements 12, depending upon the particular connection or connections required, whether simultaneous or not.

In the preferred use of the present invention as shown in FIGS. 2–5, the joining operation to be undertaken is from a quartz crystal resonator can 42 having three stub leads 44 extending therefrom. The connection is to be made from each of the leads to a substrate, printed wiring board, or flexible strip, e.g., a flex or printed circuit 46. As shown, substrate 46 is provided with a plurality of holes 48, each being plated through to form the termination of some printed lead. For the particular joining operation, leads 44 have a given cross-sectional dimension. Matched to this cross-sectional dimension of leads 44 are dimensions of key holes 28 of elements 12. The dimension of larger hole 30 is greater than the given dimension of lead 44 while the dimension of smaller slotted hole 32 is less than the dimension of leads 44. Furthermore, the width of tail 26 at tines 36 is greater than the smallest hole diameter of holes 48 in substrate 46.

Figures 2, 3, 4:
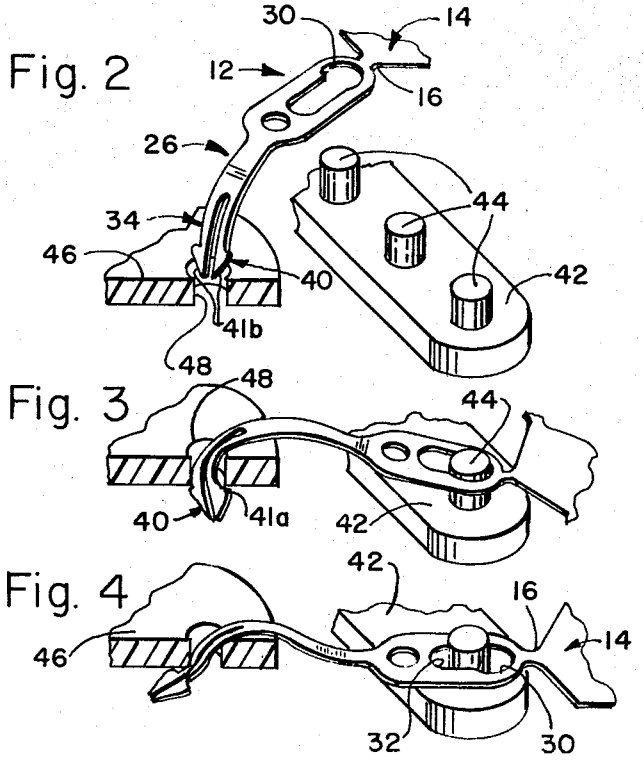
FIGS. 2–5 illustrate the sequence of operations in making a connection utilizing the present invention.

In operation, therefore, each electrical connector device 10, including its tab 14 and electrically conductive element 12 is manipulated so that each tail 26 is inserted through its respective hole 48 of substrate 46, the sloped ends **41*b* adjacent head 40 squeezing tines 36 together as end 34 passes through hole 48 for each of the three elements 12. Two or more tines or two or more tails 26, if incorporated in element 12, may be used to form multiple connections to multiple substrate holes 48. As shown in FIG. 3, after completely passing through hole 48, each head 40 snaps open and is retained within hole 48 by latches 41*a*, the greater width between tines 36 also enabling electrical connection with electrically lined hole 48**.

Thereafter and in seriatim, as shown in FIG. 3, larger hole 30 of key hole opening 28 of each element 12 is placed over its respective lead 44.

Figure 5:
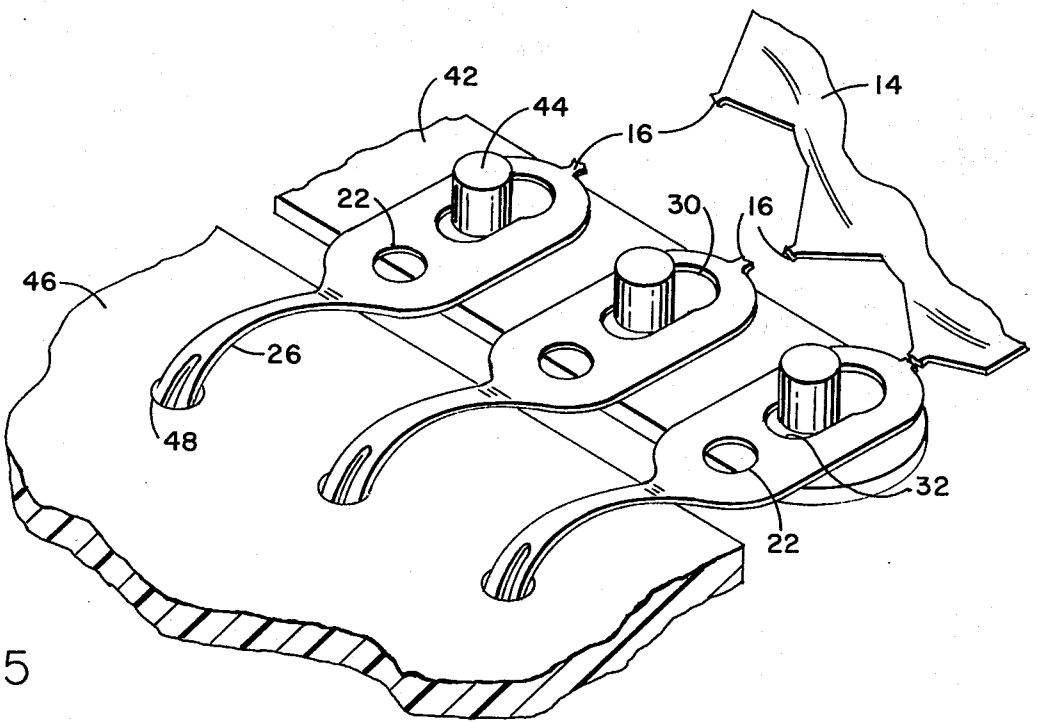

As shown in FIG. 4, by pulling on tab 14, utilizing tooling hole 20, key hole 28 is caused to move with respect to its lead 44 so that each lead 44 now provides an interference fit with its mating smaller hole 32. Upon further pulling of tab 14, as shown in FIG. 5, the tab is separated from element 12 at breakaway portion 16.

If it is required that some repair or replacement be made, whether in substrate 46, can 42, or elements 12, elements 12 may be easily removed by inserting a hooked instrument through tooling hole 22 and pulling element 12 from either or both its connections with lead 44 and hole 48. Such a tool may be a crochet hook or a small stiff wire having a bent end.

Although the invention has been described with reference to a particular embodiment thereof, it should be realized that various changes and modifications may be made therein without departing from the spirit and scope of the invention.

What is claimed is:

1. A method for electrically connecting means for defining a hole lined with electrically conductive material with a lead, comprising the steps of:

providing a tab secured by a necked-down portion to an electrically conductive element having a tail and means therein for defining a key-hole opening;

manipulating the tab for inserting the tail into the lined hole and thereby for establishing an electrical coupling therebetween;

manipulating the tab for placing the key-hole means over the lead; and pulling the tab for engaging the keyhole means by interference fit with the lead and thereafter for separating the tab from the electrically conductive element.

* * * * *